United States Patent [19]

Biró et al.

[11] Patent Number: 4,817,952

[45] Date of Patent: Apr. 4, 1989

[54] ELECTRONIC SPATIAL LOGICAL TOY CONTAINING MOVABLE AND/OR ROTATABLE ELEMENTS

[75] Inventors: Gábor Biró, Pécel; Róbert Breitner, Diósd; Gábor Fazekas, Budapest; István Hejjas, Budapest; Péter Niklai, Budapest; Ernö Rubik, Budapest; Károly Szabó, Budapest; István Tóthmátyás, Budapest, all of Hungary

[73] Assignee: Rubik Studio, Hungary

[21] Appl. No.: 939,045

[22] PCT Filed: Mar. 4, 1986

[86] PCT No.: PCT/HU86/00012

§ 371 Date: Dec. 9, 1986

§ 102(e) Date: Dec. 9, 1986

[87] PCT Pub. No.: WO86/05111

PCT Pub. Date: Sep. 12, 1986

[30] Foreign Application Priority Data

Mar. 4, 1985 [HU] Hungary ..... 784/85

[51] Int. Cl.[4] ..... A63F 9/06

[52] U.S. Cl. ..... 273/153 S

[58] Field of Search ..... 273/153 R, 153 S, 237, 273/238

[56] References Cited

FOREIGN PATENT DOCUMENTS 78485 3/1985 Hungary .

*Primary Examiner*—Maryann Lastova

*Attorney, Agent, or Firm*—Handal & Morofsky

[57] ABSTRACT

A logical toy containing movable and/or rotatable elements or element groups, the path of motion or axis of rotation thereof, including sensors staying in an actuating forced connection directly or through a mechanic transmission. One or two circuit switches are suitable for closing and opening the path of electric, magnetic or optical signals, which form, individually or in groups, one or more logical nets serving as signal transmitters. The outputs thereof are connected directly through mechanic connecting elements (4, 5, 9, 11) to an electric counter (2). The sensors, i.e. the signal transmitters (1) containing the sensors, can be connected to an electronic chronometer (6). One or more axes of the toy are hollow or tubular, and the sensors and/or their leads are arranged in the inside of the tubular axes (22) and/or in the hollow of the center-plate elements (18).

9 Claims, 3 Drawing Sheets

ELECTRONIC SPATIAL LOGICAL TOY CONTAINING MOVABLE AND/OR ROTATABLE ELEMENTS

TECHNICAL FIELD

The invention relates to a spatial logical toy containing movable and/or rotatable elements.

BACKGROUND ART

It is a well known fact that logical toys containing different movable and/or rotatable elements are most popular. In addition to the well known logical toys with numbers and pictures comprising 15 elements, recently spatial toys, as e.g. the "Magic Cube" and "Magic Domino" became quickly popular all over the world. With these toys international competitions have been organized. During the competition the task of the competitors lies in the setting of the scrambled elements of the logical toy into their original position and order of sequence within the possibly shortest time. Accordingly, the succes of the competition does not depend only on the logical capability of the competitiors but also on their manual skill in respect to the algorithms of systematic arranging which has been worked out in advance. However, from the aspect of measuring logical abilities, it seems to be more realistic to aim at the minimal number of manipulations needed for moving resp. rotating the elements for obtaining the proper order of sequence instead of the observance of the minimal duration of arranging. The winner of this type of competition could be the person who is able to solve the task of arranging within a prescribed time with the least element-moving operation.

For the practical realization of such a competition the only possibility lies in that the members of the jury should watch and keep in evidence the motions of the competitors with utmost care. However, this method is wearisome and involves possibilities of error, accordingly, these competitions could not be expected to become wide spread.

DISCLOSURE OF INVENTION

The aim of the invention is to develop a construction which enables automatic counting and continuous registration of element-arranging steps without error, as well as measuring the duration of arranging with logical toys having an arranging character and being suitable for competitive purposes.

The invention is based on the recognition, in so far as, by the aid of sensors associated with the movable and/or rotatable elements or element groups and remaining in a mechanically forced connection therewith, directly or indirectly electric signals can be generated for counting the steps of arranging; such electric signals can be counted by an electric counter, even more, by means of the electric signals as they switch-on and-off, an electronic chronometer can be controlled for measuring the time used for arranging.

Accordingly, the invention relates to a spatial logical toy containing movable and/or rotatable elements.

The essence of the invention lies in that to the movable and/or rotatable elements or element groups or to their paths of motion or axes of rotation sensors—remaining in a functional forced connection—assigned, which can be also electric, magnetic or optical switches and, an electrically actuated counter is connected thereto, or to the signal devices thus interconnected.

In another embodiment of the logical toy according to the invention, in addition to the counter the sensor is connected, a chronometric circuit which—after having been set to zero, will automatically start upon the first change in condition, which is an arranging step. If the elements of the original mechanic logical toy serving as a base unit, are forming rotatable element groups, or plates, as it is the case with the RUBIK's Cube (disclosed in Hungarian Pat. No. 170 062) or with similar toys, the invention can be realized in a most expedient manner such that in addition to the elements forming the plate-center, the stationary axes thereof are also hollow, possibly tubular, and the sensors are arranged therein. In this case it is worth placing the counting chronometric circuits formed suitably as integrated circuits alone with the digital displays in the cavity of one of the elements in the plate-center. It is also considered as advantageous, if axially movable elements of the claw-type or mechanical elements having an end surface with a pitchlike curvature or with a face groove are inserted for the actuation of the sensors.

BRIEF DESCRIPTION OF DRAWINGS

The invention will be described in details by the aid of the drawings enclosed, wherein.

BEST MODE OF CARRYING OUT THE INVENTION

Figure 1:
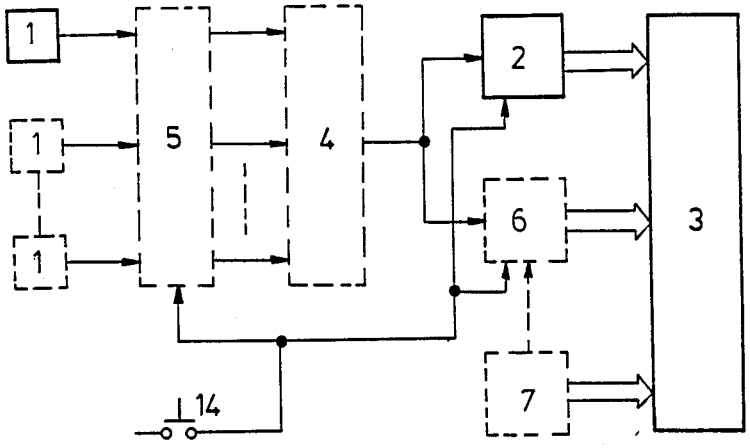
FIG. 1 shows an example for the electric block schematic of the construction according to the invention.

In FIG. 1 the outputs of signal transmitters 1 are connected to the input of the counter 2, by inserting a conditionally applicable or omissible and therefore indicated with a dotted line, state—register 5 and change-sensing circuit 4, while the output of the counter 2 is connected to the input of a display 3. Further inputs of the display are connected with the outputs of a conditionally contained digital chronometer 7 and an electronic chronometer 7 (indicated with dotted lines), whereas the input of the electronic chronometer and input of the counter 2 are formed as common inputs. The cancelling push-button (clear key) 14 is connected to the null-setting inputs of the counter 2, the state-register 5 and the electronic chronometer 6.

Figure 2:
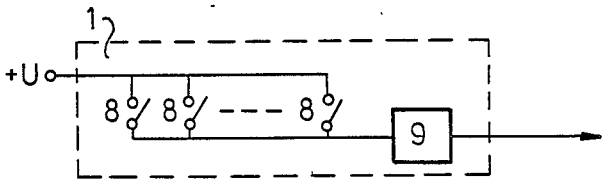
FIGS. 2 and 3 are examples for the possible logical layout of the signal transmitters.

As it is to be seen in FIG. 2, the signal transmitter 1 consists of parallel-connected connection-contacts 8, one of the poles of which are connected to the +U supply voltage, while their other poles form the outputs of the signal transmitter 1 via a bounce-filter circuit 9.

Figure 3:
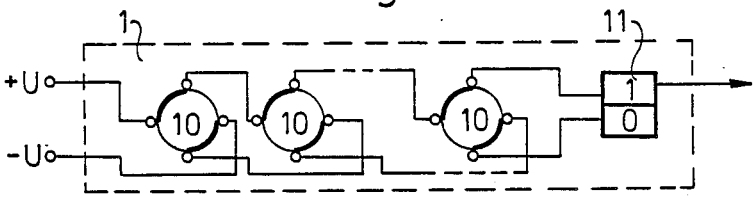

The embodiment according to FIG. 3 comprises the serial effect-chain of the rotatable two-circuit cross-switches 10, the input leads of which are connected to the +U and −U supply voltages, while the outputs are connected to the inputs of a static level-controlled bistable circuit (flip-flop) 11 and the one (1) output of the latter one forms the output of the signal transmitter 1.

Figure 4:
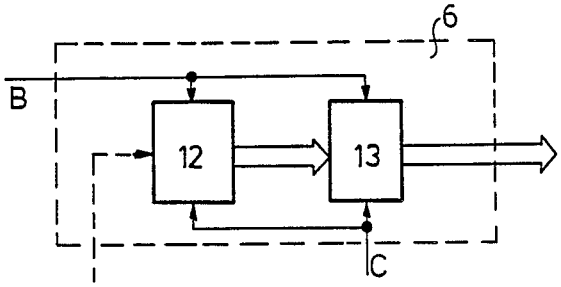
FIG. 4 illustrates a possible internal construction of the electronic chronometric circuit.

With the embodiment according to FIG. 4 the electronic chronometer 6 consists of a digital stop-watch 12 and the output register 13; the output of the former one and the input of the latter one are interconnected. The output of the output register 13 forms the output of the electronic chronometer 6. The control input of the circuit 6 is connected to the starting input of the digital stop-watch 12 as well as to the input of the output register 13, controlling write-in activity. Null-setting or resetting input C of the circuit is connected partly to null-setting and stopping input of the digital stop-watch 12, partly to the null-setting input of the output register 13.

Figure 5:
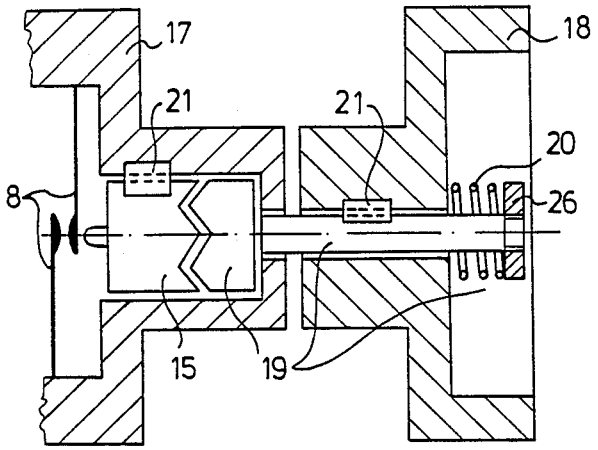
FIGS. 5 to 7 show some versions for the preferred construction for the mechanical actuation of the sensors.

FIG. 5 shows an embodiment, with which the connection contact 8 is arranged in the central element 17 of the "Magic Cube", together with an intermediate piece 15 with claw-type toothing, bearing up against said contact and a rotation preventing arrester catch 21, as well as an upper end of a shank carrying a plate-center 19 with the clawed endsurface. A plate-center element 18, secured by the arrester catch 21, is arranged on said shank, the hollow of the plate-center element 18 holds a spring 20 and a counternut 26.

Figure 6:
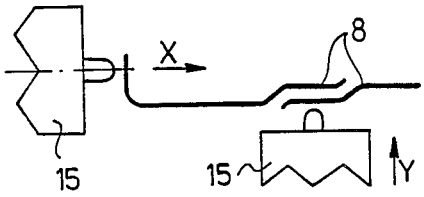

As it is seen in FIG. 6, in the transverse direction "y" and longitudinal direction "x" the intermediate piece 15 each is bearing up against the connection-contact 8 consisting of the slanted resp. staggered overlapped pair of springs.

Figure 7:
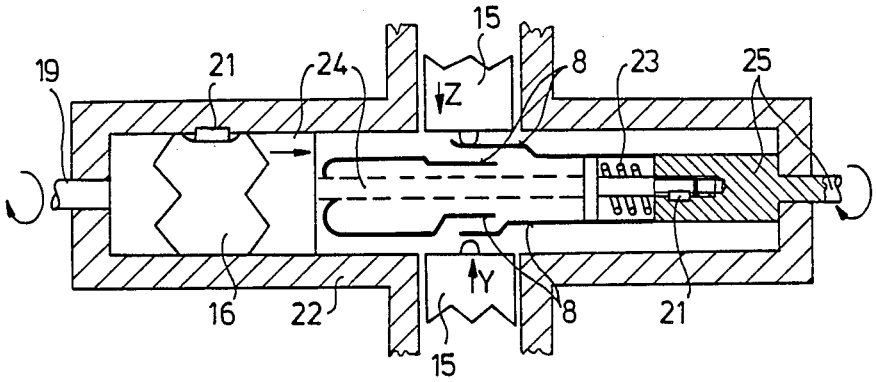

FIG. 7 shows an embodiment of the invention, with which in the tubular shaft 22 having been formed in the middle of the "Magic Cube" one by one the following components are arranged: the clawed endpart of the shank carrying the plate-centre 19, the intermediate piece 16 with the double claws and secured with the arrester catch 21, an intermediate piece 24 with a handle. One half-spring of the connection-contacts 8 is attached to the intermediate piece 24, the long spring 23, as well as to the protruding end of the hollow shank carrying the plate-centre 25 and is secured to the intermediate piece 24 by means of a further arrester catch 21. The other half-spring of the connection-contacts 8 is connected to the hollow shank.

The cam end of the intermediate piece 15 each is connected loosely to contacts 8.

Figure 8:
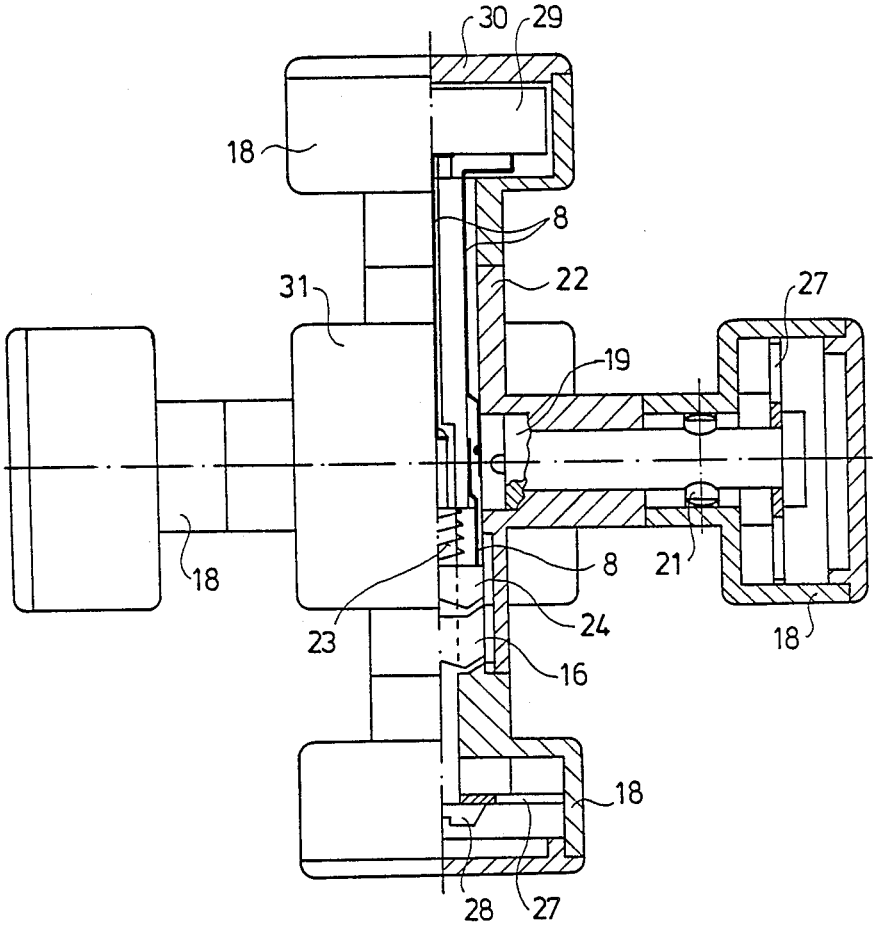
FIG. 8 shows a possible embodiment of the invention.

FIG. 8 shows a possible mode of realization. The electronic signal processing and displaying unit 29 is arranged below the windowed lid 30 unit 29 accomplishes the functions explained according to FIG. 1. The connection-contacts 8 control the electronic signal processing and displaying unit 29. The connection-contact 8 having been arranged in the hollow shank 25 carrying the plate-center forms, by the intervention of the intermediate piece 24 together with the handle and the long spring 23, the common point of the switches in the tubular axis 22. The active connection-contacts 8 of the switches are lying between the inner wall of the tubular axis 22 and the outer wall of the hollow shank 25 carrying the plate-center and they are connected to the electronic signal processing unit 29.

The electronic spatial logic toy containing movable elements according to the invention operates, as follows:

The circuit arrangement according to FIG. 1 operates, as follows:

At the simplest version of the arrangement only the elements indicated with the continuous line are taking part in the operation, that is, one single signal transmitter 1, the counter 2, the display 3 and the resetting push-button 14. Prior to beginning the game, by pressing the push-button (clear key) 14 the counter 2 is set to null. Thereafter, upon every single step of arranging the signal transmitter 1 sends a pulse each time to the counter 2; the pulses are counted in the counter 2, the current digital value is displayed on the display 3, displaying thus the total number of steps, when rearranging of the toy to its original state is finished. If duration of arranging is intended to be measured, the circuit arrangement must contain the electronic chronometer 6, which can be set to zero, be stopped by means of the cancelling push-button (clear key) 14, and which is restarted from zero upon the first counting pulse; thereafter, after every single step it delivers the span of time reckoned from the first step to the very last step on its output. A possible layout of the electronic chronometer 6 will be explained in connection with FIG. 4. The digital chronometer 7 represents a further special unit, which indicates the actual time to the display 3. The display 3 may display simultaneously the aforementioned numerical values, however, a construction is also possible, with which the date intended to be displayed may be displayed by means of a selector switch, enabling a more economical way of displaying. The internal timing signal of the digital chronometer 7 may be possibly used also for the electronic chronometer 6, enabling a more simple construction of the circuit arrangement. This possibility is indicated by the dotted line in FIG. 1, referring to the signal lead interconnecting the electronic chronometer 6 and the digital chronometer 7. In case, if a plurality of signal transmitters 1 is used, the circuit 4 for sensing the changes has to be also included inserted. The task of circuit 4 lies in that upon every change in the signal level appearing at any input channel or upon the appearance of a pulse, it will send an output pulse each time to the counter 2. In case, if a state-register 5 is also contained, the content of the latter one, i.e. the bit sample is a code of the type "N minus 1", in which the single logic signal "1" indicates the channel which was active at the last one of the input channels. Now, if the signal transmitters are alternatively activated, the content of the state-register 5 will change with every single step, while if the same signal transmitter 1 is actuated repeatedly, the content of the state-register 5 does not change. At the beginning of the game the state-register 5 is also set to zero by means of the cancelling push-button (clear key) 14. Thereafter, at every change of the content of the state-register 5 the circuit 4 sensing the change is sending a pulse each time to the counter 2 and the electronic chronometer 6, which means that operation is taking place similarly, as earlier described. The only difference lies in that every repeated actuation of the toy elements associated with the same signal transmitter 1, no matter how many, counts as one single step. This is of importance, if the character of the game requires the application of rules of games involving this type of counting. So e.g. a counting rule may be laid down for the Rubik's Cube, according to of which repeated turn of the same plate by a quarter or half of a full turn is counted as one single step. As for the technical solution of the signal transmitters 1, any miniaturized well-known sensor can be used for this purpose, which is suitable for sensing displacements or angular displacements in discrete steps, such as an electric contact, or a sensor operating on optical, magnetic, inductive, capacitive etc., principle or a logical arrangement consisting of a plurality of such sensors. In practice, electric contacts can be used most economically for this purpose, however, in dependence of the structural design of the toy, a satisfactory solution can be achieved by using optical switches with conductive filaments or magnetic switches containing movable ferromagnetic shunts.

FIG. 2 shows a signal transmitter 1 containing a plurality of electric contacts. In standstill of the toy every connection contact 8 is open. During an arranging step each one of the connection contacts closes for a short time and gives +U voltage to the input of the bounce filter 9, thereafter it interrupts again. In such a manner on the output of the bounce filter 9 a regular rectangular pulse appears which is well suitable for controlling the counter 2. In case, if we wish to realize the logical connection according to FIG. 2 that is with optical switches, instead of the +U supply voltage a LED light source issued and instead of the bounce filter 9 an electrooptical coupling element is necessary.

The version according to FIG. 3 operates, as follows:

The serial effect-chain of the cross-switches 10 serving as sensors guarantees that the +U supply voltage gets to one input of the flip-flop 11, while the −U supply voltage is led to the other input. During any arranging step one of the cross-switches 10 is turning with a quarter of a total turn and, as a consequence the +U and −U voltages are interchanged on the inputs of the flip-flop are interchanged, which flips over, while the counter 2 is counting the flipping motions.

The task of the electronic chronometer 6 according to FIG. 4 is to produce the numerical value of the span of time between the first step and the last step of arranging. At the beginning of the game the electric signal given to the input "C" will set to zero the digital stop-watch 12 and stops its function. It sets to zero also the content of the output register 13. Electric pulses indicating the arranging steps arrive to the input "B". Any pulse of this kind is stopping the function of the digital stop-watch 12, or if it is already going its, functioning is not influenced at all additionally, the same signal commands the output register 13 to write-in and, as a consequence, it takes over the momentary numerical value of the stop-watch 12, thus on the output always the span of time can be read, which elapsed up to the last arranging step. It should be mentioned that in case, if the system contains a digital chronometer 7, the internal timing pulse thereof can be used for actuating the digital stop-watch 12 and, as a consequence its construction becomes more simple, especially if a commercially available digital chronometer 7 is used, it can be used as a stop-watch, if it has the proper function mode.

With the mechanical arrangement according to FIG. 5 by turning the plate-center element 18 by a quarter, as a consequence of the rotary motion of the shank carrying the plate-center 19, the intermediate piece 15 with the clawed toothing, the rotation of which is hindered by the catch 21, is displaced to the left, and the protruding cam thereof is closing the connection-contact 8 in the center-element 17. After having finished such quarter-turn, the connection contact springs back and interrupts.

FIG. 6 shows a connection-contact 8 which can be actuated from two directions. From the slanted resp. staggered overlapped formation it becomes obvious that it will be closed, whether displacement is taking place in the direction "x", or in direction "y".

With the enbodiment according to FIG. 7, if the upper intermediate piece 15 is moved in the direction "z", or the lower intermediate piece 15 is moved in direction "y", respectively the upper or the lower connection-contact 8 will close.

The intermediate piece 16 having the double claws and prevented in rotation by the catch 21 makes sure that either the shank carrying the plate-center 19 on the left is turned, or the hollow shank carrying the plate-center 25 on the right side is turned, each one separately. The intermediate piece 24 with the handle will turn in direction "x" (to the right) to such an extent that the lower connection-contact 8 is already closing, while the upper connection-contact 8 is still open. However, if both shanks are turned simultaneously, displacement of the intermediate piece 24 with the handle will be of the double extent, i.e. the structure acts as a mechanical summing unit, so the upper connection-contact 8 is also closing.

By employing the mechanical solutions according to FIGS. 5 to 7, and by forming the electronic and displaying circuits as miniaturized integrated circuits, the invention can be applied most economically and suitably for serial production for the "Magic Cube" of Rubik.

In this case it seems to be expedient to arrange the integrated circuit containing the electronic units in the hollow of the plate-center element 18, which is connected, according to FIG. 7—to the hollow shank carrying the plate-center 25 on the right side of the tubular axis 22. Therefore, the electric connection of the co-rotating connection-contacts 8 could be solved in a simple manner. Accordingly, the tubular axis according to FIG. 7 is playing a special role in the layout of the whole construction and can be considered as the preferred main axis of the toy.

If any of the plate-center-elements 18 having the horizontal axis seen in FIG. 8, is turned then, due to the paths formed on the shank carrying the plate-center 19 and the tubular axis 22, the shank carrying the plate-center 19 will also turn axially, and closes the opposite lying switch consisting of the connection-contacts 8. Turning of the shank carrying the plate-center 19 is promoted by the catch 21, while the axial motion is limited by the leaf spring 27, simultanously ensuring the dilatation needed for turning the cube. The plate-center elements 18 with the horizontal axis according to FIG. 8 are closed with the lid 31.

If the upper one of the plate-centre elements 18 having the vertical axis according to FIG. 8 is turned, the hollow shank carrying the plate-center 25 is co-rotating, so are the intermediate piece 24 with the handle and the fixing screw 28. Under the influence of the forced trajectories on the intermediate piece 16 with the double claws and the intermediate piece 24 with the handle, the connection-contacts 8 are performing the vertical motion as can be seen in the FIG. 8 and establish the connection desired.

Now, if the lower plate-center element 18 with the vertical axis according to FIG. 8 is turned, the intermediate piece 16 with the double claws is also turning and under the influence of its own forced trajectory and that on the intermediate piece 24, it will lift the intermediate piece 24 with the handle and closes the connection-contacts 8. In this case dilatation needed for turning the vertical axis is assured by the leaf spring 27 to be found in the lower plate-centre element 18 with the vertical axis according to FIG. 8.

The advantage of the invention lies in that by the aid of the relatively simple, miniaturized structural elements, being well suitable for mass production, the toys with the movable and/or rotatable elements can be brought to a far higher level, as both counting of steps and accurate measuring of the arranging time, even breaking it down to hundredths of seconds, are successfully solved. Consequently requirements in respect to applicability for competitions are also met. A further ancillary advantageous feature lies in that in case of application of the digital chronometer 7 according to FIG. 1, the toy, when out of use, can be used as a digital table clock with pleasant aesthetic appearance. The invention can be preferably applied first of all for the further-development of mechanical toys with aesthetic appearance and of complex toys with a puzzle character played on a higher level, as such the well known "Magic Cube" of Rubik (Rubik's Cube).

We claim:

1. A logical toy comprising:

(a) movable elements adapted for movement along paths of motion;

(b) first means for connecting the elements, directly or through mechanical transmissions;

(c) sensors coupled to said first connecting means and configured to be allowed to remain in an actuated forced configuration;

(d) a respective circuit switch associated with each sensor for opening or closing a respective signal path;

(e) said circuit switches forming a logical unit serving as a signal transmitter having an output;

(f) electric counter means (g) second means connecting said output to said electric counter means; and (h) wherein said logical toy is dimensioned to be hand held and wherein said elements are manually moveable.

2. A logical toy as claimed in claim 1, wherein an electronic chronometer is connected to the logical unit.

3. A logical toy as claimed in claim 1, wherein the counter means is connected to the signal transmitter through a change sensing register.

4. A logical toy as claimed in claim 1, wherein the elements form commonly rotatable element groups along one or more axes, said elements being hollow, with said sensors having associated leads, and the associated leads thereof being arranged along the direction of said axes passing within the hollows of the elements.

5. A logical toy as claimed in claim 4, wherein an electronic chronometer is connected to the circuit switches, said chronometer being connected to a display, and wherein the counter, the chronometer and the connected display are arranged in the hollow of at least one of said elements.

6. A logical toy as claimed in claim 4, wherein said logical toy has a preferred main axis and between the elements on the ends of said main axis there is a mechanical summing construction and at least one of said sensors is in an actuating forced connection therewith.

7. A logical toy as claimed in claim 4, wherein the sensors each comprise axially movable mechanical cam elements each having an end face with a sloped shape whereby rotation of a movable element with respect to another movable element causes said movable element to be displaced with respect to other movable elements and actuate its respective sensor.

8. A logical toy as claimed in claim 7, wherein said sensors comprise connection contacts which include slanted or staggered overlapping contact pairs, and means for activating said contact pairs from two or more perpendicular directions.

9. A logical toy as in claim 7, wherein said circuit switches comprise a pair of resilient spring contacts and wherein one of said cam elements is mounted for displacement along its axis and is positioned to push against one of said resilient spring contacts to close one of a said circuit switches and the other of said cam elements is mounted for axial rotation and is coupled to a movable element.

* * * * *